United States Patent [19]

Javorik

[11] Patent Number: 4,590,655

[45] Date of Patent: May 27, 1986

[54] METHOD FOR EXPANDING A TUBULAR MEMBER

[75] Inventor: Laszlo Javorik, Oregon, Ill.

[73] Assignee: Grotnes Metalforming Systems, Inc., Chicago, Ill.

[21] Appl. No.: 748,030

[22] Filed: Jun. 24, 1985

Related U.S. Application Data

[63] Continuation-in-part of Ser. No. 574,282, Jan. 26, 1984.

[51] Int. Cl.[4] ..... B23P 17/00

[52] U.S. Cl. ..... 29/421 R; 29/234; 72/58; 72/62

[58] Field of Search ..... 72/59, 60–63; 29/421 R, 234

[56] References Cited

U.S. PATENT DOCUMENTS 3,359,624 12/1967 Cour et al. ..... 29/421 R
4,052,872 10/1977 Herr ..... 72/62
4,109,365 8/1978 Tygart ..... 72/62
4,364,251 12/1982 Nishihara ..... 72/62
4,513,497 4/1985 Finch ..... 72/58

FOREIGN PATENT DOCUMENTS 583147 9/1959 Canada ..... 72/62

*Primary Examiner*—Leon Gilden
*Attorney, Agent, or Firm*—Marshall, O'Toole, Gerstein, Murray & Bicknell

[57] ABSTRACT

A tubular metal member undergoes expansion transverse to the longitudinal axis of the member. An axial compressive load is applied to the member parallel to the member's longitudinal axis, and the member is allowed to deform transversely to said axis. Procedures are employed to control the deformation of the member, to prevent the member from buckling, and to ensure that the ends of the member will be expanded uniformly with the remainder of the member.

31 Claims, 4 Drawing Figures

METHOD FOR EXPANDING A TUBULAR MEMBER

This application is a continuation-in-part of application Ser. No. 574,282, filed Jan. 26, 1984, and the disclosure thereof is incorporated herein by reference.

BACKGROUND OF THE INVENTION

The present invention relates generally to cold deforming of metal and more particularly to a method for expanding an elongated tubular member in directions transverse to the longitudinal axis of the member.

Expansion of tubular members for work hardening, sizing and rounding is old and well known. Conventional methods for expanding tubular members do so by applying forces to the interior wall surfaces of the member.

For example, one such method old in the art employs a mechanical pipe expander. The expander includes an expander head comprising a plurality of circumferentially spaced radially expandable die segments that are disposed around a cone located near the end of a drawbar. The pipe is expanded by advancing the pipe over the expander head and then forcing the drawbar cone against the dies to cause the dies to move radially outwardly against the interior wall surface of the member.

Methods employing the above-described mechanical pipe expander suffer from a number of limitations and disadvantages, however. Tubular members of a length greater than the length of the expander head dies must be expanded incrementally, which is time consuming and expensive. Members having a large thickness to inside diameter ratio may not be expandable at all by this method where the expander head and drawbar cannot be made small enough to fit inside the pipe and at the same time provide sufficient force to cause the desired expansion. Application of the method aggravates any irregularities in the wall thickness of the member, i.e. the thinner areas get thinner. Because the expansion is performed incrementally, the member will become less straight due to differential strains impressed upon the member adjacent to the zone of expansion. When the expander head is retracted, the member will spring back to some degree, which must be accounted for. Little control can be exercized over non-uniformities in the outer diameter of the member. And finally, the expansion force cannot exceed the true ultimate strength of the member, and thus the true ultimate strength of the member cannot be increased.

Another conventional expansion method employs fluid pressure inside of the tubular member. A liquid, for example, may be pumped into the sealed interior of a member until the pressure of the liquid is sufficient to cause the member to expand. Alternatively, explosives may be located inside of the member to create a percussive force sufficient to cause an expansion.

Methods employing the above-described hydrostatic expansion suffer from many of the disadvantages described in regard to the mechanical pipe expander. Application of the method aggravates any irregularities in the wall thickness of the member. When the expansion pressure is relieved, the member will spring back to some degree, which must be accounted for. It is difficult to control the amount of expansion with the hydrostatic method. The expansion force cannot exceed the true ultimate strength of the member, and thus the true ultimate strength of the member cannot be increased. In addition, the hydrostatic expansion method requires a time-consuming sealing of the member as well as expensive pumping equipment or explosive devices. And, enormous pressures may be required to expand members having thick walls, exacerbating the pumping and sealing requirements.

Expansion of one tubular member inside of another member having an axially extending tubular cavity for purposes of lining the other member with the expanded member is also old in the art. The conventional methods described above can be employed for this purpose by inserting the liner member inside of the other member and expanding the two together. The materials comprising the liner member and the other member are chosen such that the other member will spring back more than the liner member after expansion, thus capturing the liner member. These methods are disadvantageous, however. The choice of materials is limited by the relative spring back requirements, and the expansion force required must be sufficient to expand both the liner member and the other member at the same time.

SUMMARY OF THE INVENTION

The present invention relates to a method for expanding elongated tubular members in directions transverse to the longitudinal axis of the member through axial compression of the member.

The method of the present invention broadly comprises applying a compressive load to the end of the member, the load being parallel to the longitudinal axis of the member, and allowing the member to deform in at least one direction transverse to the member's longitudinal axis. Expansion of up to 6% has been obtained without wall buckling, and the method will work for any elongated tubular member with a cross-sectional radius of curvature less than infinity.

In the preferred embodiment of the invention an encasement is employed to limit or control the transverse deformation of the tubular member, and to ensure that the member will not buckle as the compressive load is applied to it. The encasement may surround the outer surface of the member to control outward expansion. Alternatively or in addition, an insert may be located inside of the member to control inward deformation or inner wall buckling, which may occur when particularly high compressive loads are applied to the member. Further, the encasement may be shaped to allow localized expansion of the member where, for example, a protrusion is to be formed on the member's outer surface. The encasement may be split to allow for easy removal of the expanded member.

In the case of expanding a relatively long and slender tubular member (length aproximately three times greater than the diameter), the encasement may also be split into several sections along its length, each section capable of longitudinal movement relative to an adjacent section. In this embodiment, compression of the tubular member within the encasement causes the encasement to move with the longitudinal deformation of the member so as to avoid the effects of friction which may inhibit uniform longitudinal deformation (and related transverse deformation) of the member.

Because the axial compressive load is typically applied to the member by forcing a piston against the end of the member, transverse frictional forces will develop at the piston-member interface. This is also true at the opposite end of the member where the member is restrained from longitudinal displacement. These friction forces tend to bind the ends of the member such that transverse expansion is impeded. One embodiment of the present invention includes applying the axial compressive load to the member with a piston having a beveled surface at the piston-member interface. This beveling provides transverse forces opposing the friction forces just described. A similarly beveled restraining piece could be located at the opposite end of the member. In this embodiment, the ends of the member will expand uniformly with the remainder of the member.

The application of compressive loads of less than approximately 110% of the true ultimate strength of the member causes the member to expand outwardly without increasing the wall thickness of the member. Loads of this magnitude, however, will not serve to increase the true ultimate strength of the member, as described in the above-identified parent application. It may thus be desirable to apply loads at greater than approximately 110% of the true ultimate strength of the member. At this load level, the wall thickness of the member tends to increase. Further, at loads greater than approximately 130% of the true ultimate strength of the member, the member inner walls may begin to buckle. Such wall thickening or buckling may be controlled or limited by employing an inner insert as described above.

The advantages of the method of the present invention over conventional methods are numerous. The method is economical and requires very little time. Long members may be expanded in a single pass in a non-segmented fashion. Because the member is deformed in one pass by compressing it against an encasement, improvements in the member's straightness and surface uniformly can be expected. Further, compressing the member causes an advantageous plastic flow of the material comprising the member, resulting in greater uniformity in the member's wall thickness. And, there is no spring back of the member after the expansion force is removed.

In addition, the strength properties of the member can be increased advantageously as a result of an expansion according to the method. Where the axial compressive force is applied at a magnitude greater than the elastic limit of the member, the elastic limit of the member will be increased. Where the force is applied at a magnitude greater than the yield strength of the member, the elastic limit and the yield strength of the member will be increased. And, where the force is applied at a magnitude greater than the true ultimate strength of the member, the elastic limit, yield strength and true ultimate strength of the member will be increased.

Another embodiment of the method of the present invention is employed to line another member having an axially extending tubular cavity with the expanded tubular member. In this embodiment, the other member is used as the encasement, and the encasement thus entails no additional cost. The liner member is expanded until the outer surface of the liner member contacts the inner surface of the member to be lined. Because there is no spring back of the liner member, the liner member will be securely held within the other member by friction without the need to expand the other member. Thus, the expansion force required is only that which is necessary to expand the tubular liner member, and the materials constituting the liner and other member are not limited by any relative spring back requirements.

Other features and advantages are inherent in the method claimed and disclosed or will become apparent to those skilled in the art from the following detailed description in conjunction with the accompanying drawings.

DETAILED DESCRIPTION

Figure 1:
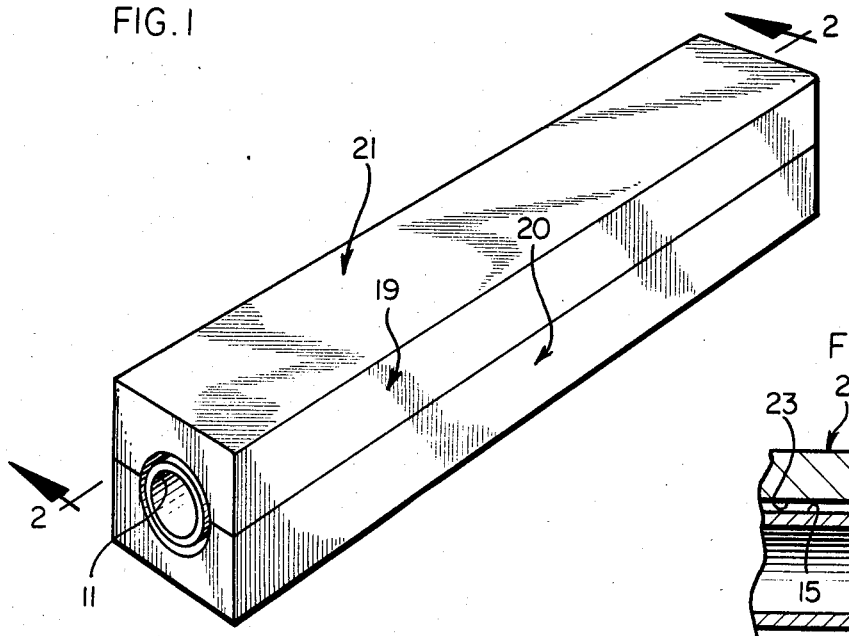
FIG. 1 is a perspective of an encasement utilized to limit the outward expansion of an elongated tubular member positioned therein, in accordance with an embodiment of the present invention.

Indicated generally at 11 in FIG. 1 is an elongated tubular member 11 located within a cavity in an encasement block 21. Tubular member 11 is subjected to an expansion method in accordance with an embodiment of the present invention to produce a finished product indicated generally at 11*a* in FIG. 3.

Figure 2:
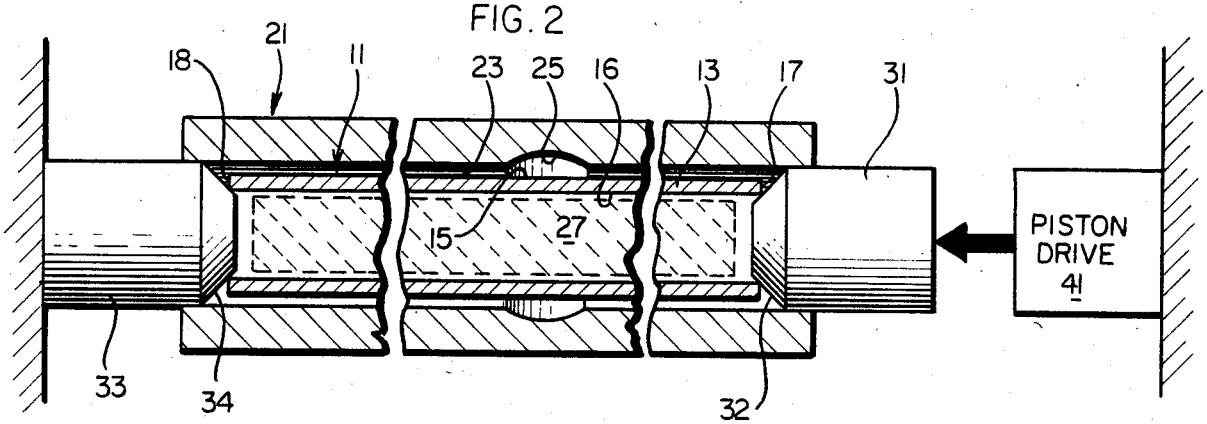
FIG. 2 is a sectional view, taken along line 2—2 in FIG. 1, showing the elongated tubular member in an unexpanded state and also showing an embodiment of additional apparatus in accordance with the present invention.
Figure 3:
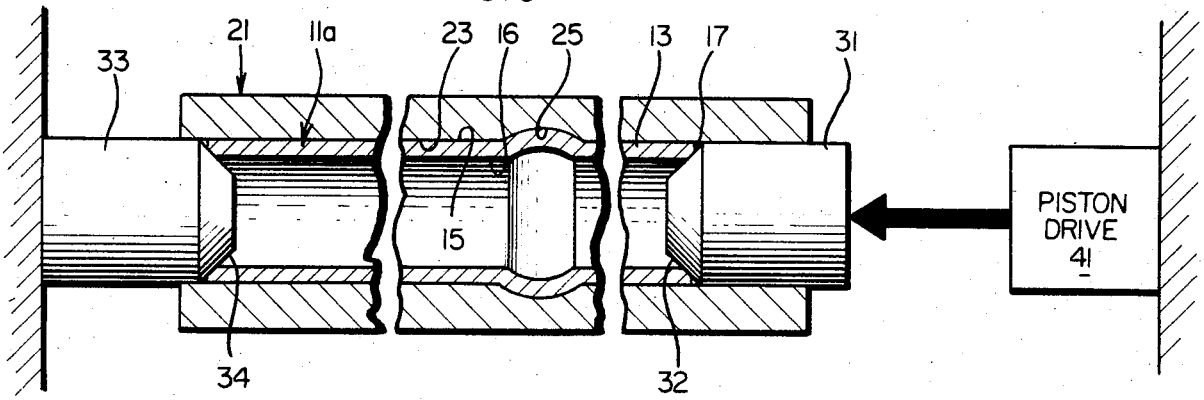
FIG. 3 is a view similar to FIG. 2, showing the elongated tubular member in an expanded state.

Referring to FIGS. 2 and 3, tubular member 11 comprises a wall portion 13 defined by outer wall surface 15 and inner wall surface 16, and ends 17 and 18. Encasement block 21 includes a cavity defined by inner surface 23 which follows the longitudinal axis of the encasement block. The cavity is open at both ends so that the tubular member 11 can be inserted into the cavity as shown. Encasement block 21 is formed of rigid material such that the walls of the cavity will not deform at the compressive load to be applied to tubular member 11. Encasement 21 may be lubricated or split into portions 19 and 20 to facilitate insertion and removal of tubular member 11.

Further, in the case of expanding a relatively long and slender member, encasement 21 may be split into longitudinal sections, each section capable of movement relative to an adjacent section. Such an encasement, described with particularity in the above-identified parent application, avoids the effect of friction which may inhibit uniform longitudinal deformation (and related transverse deformation) of the member 11.

The size and shape of the cavity in encasement block 21 determines the expansion that tubular member 11 will undergo. Encasement inner surface 23, which defines the cavity, generally conforms to, but is transversely or radially spaced outwardly from outer wall surface 15 of unexpanded tubular member 11. The spacing allows tubular member 11 to expand outwardly in directions transverse to the longitudinal axis of the member until the member's outer wall surface 15 contacts inner surface 23 of the encasement.

Figure 4:
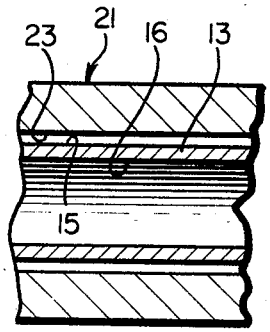
FIG. 4 is a fragmentary sectional view simliar to FIG. 2, but showing an embodiment of an alternative apparatus in accordance with the present invention.

Encasement inner surface 23 may include a localized recess 25 located between the ends of the encasement. Recess 25 allows for localized expansion of that part of tubular member 11 adjacent the recess. Of course, where such localized expansion is not desired, recess 25 would not be included in the encasement, as shown in FIG. 4 which illustrates that portion of encasement block 21 occupied by recess 25 in the embodiment of FIG. 3. Alternatively, where only localized expansion is desired, the encasement would be formed with an inner surface 23 that is very close to the outer wall surface of the unexpanded tubular member, except at the recess where expansion is to occur.

In addition to providing control over the expansion of tubular member 11, encasement block 21 also provides support for the member transverse to the longitudinal axis of the member. This transverse support ensures that the member will not buckle as the compressive load is applied to the member in accordance with the invention. Such transverse support is particularly desirable where the member is long and slender.

Tubular member 11 is expanded transversely by applying an axial compressive load to the member parallel to the member's longitudinal axis. In order to apply the desired compressive load to tubular member 11, a piston 31 is inserted into one end of the cavity of encasement block 21. Piston 31 is pressed or urged against the corresponding end 17 of the member by piston drive 41. Longitudinal movement at opposite end 18 of member 11 is prevented by a restraint 33.

In an alternative embodiment, not shown, an additional piston and piston drive indentical to piston 31 and piston drive 41 may be substituted for restraint 33. In this embodiment, the pistons are urged relatively towards each other by their respective piston drives. This embodiment is advantageous from the standpoint of reducing the cumulative friction between the member and the encasement as the length of the member is reduced during expansion.

The cross-section of the piston 31 is larger than the inner cross-section of tubular member 11, both before and after transverse expansion of member 11, except at the piston's beveled face 32, as described below. This ensures that the piston will not be pushed through the inside of the member as the compressive load is applied. The piston cross-section is also slightly less than the cross-sectional dimension of the cavity in encasement block 21, so that the piston will fit into the cavity to the extent necessary to compress tubular member 11.

In the embodiment shown, restraint 33 is of a cross-section like that of piston 31 and fits into the cavity at the opposite end of the encasement. The restraint need not necessarily fit inside the encasement cavity, however, and it may be larger in cross-section than the cavity. The restraint may also be constructed as an integral portion of the encasement.

As piston 31 is pressed against end 17 of member 11, transverse frictional forces develop at the interface between member end 17 and the face of piston 31, as well as at the interface between the member's opposite end 18 and the face of restraint 33. These frictional forces tend to bind the ends of the member and impede the desired transverse expansion at those ends.

To offset the aforesaid interface frictional forces, piston 31 is provided with a beveled face 32 and restraint 33 is provided with a similar beveled face 34. The beveling shown is in the form of a shallow conical surface which is at its smallest diameter at the portion of the piston or restraint which first contacts the end of the member. Generally, the conical surface should form an angle of no greater than 10 degrees relative to the piston face. When the piston is urged axially inwardly toward member 11, the beveling applies transversely outwardly directed force components to the end of the member, and these forces oppose the expansion-impeding frictional forces. Thus, ends 17 and 18 of the member 11 are caused to expand uniformly with the remainder of the member.

The magnitude of the compressive load applied to tubular member 11 must be at least sufficient to cause the desired expansion. Further, as described with particularity in the above-identified parent application, various strength properties of the member may also be increased by application of a load of a particular magnitude. For example, to increase the elastic limit of tubular member 11, a compressive load (per unit of member cross-sectional area) in excess of the elastic limit of the member must be applied. To increase the yield strength and elastic limit of member 11, a compressive load in excess of the yield strength of the member must be applied. And, to increase the true ultimate strength, yield strength and elastic limit of member 11, a compressive load in excess of the true ultimate strength of the member must be applied.

The application of compressive loads (per unit of member cross-sectional area) of less than approximately 80% of the true ultimate strength of the tubular member causes the member to expand outwardly without increasing the thickness of wall 13 of the member. At compressive loads greater than 110% of the true ultimate strength of the member, the thickness of wall 13 of the member tends to increase. Further, at compressive loads greater than approximately 130% of the true ultimate strength of the member, the inner wall of the member may have a tendency to buckle. If inward deformation or buckling of the member as a result of the greater compressive loading is undesirable, an insert 27, shown in FIG. 2, may be positioned adjacent inner wall surface 16 of the member 11 to prevent or limit such inward deformation or buckling.

Following expansion of tubular member 11, the member is generally removed from encasement 21 or insert 27. As described above, a split encasement 21 or lubrication thereof may be used to facilitate such removal.

As stated above, and as shown in the drawings, it is the application of the compressive load to the ends of the tubular member which causes the member to expand. Thus, the method of the present invention allows the member to expand without applying any, or any substantial, hydraulic pressure to the interior of the member.

Where member 11 is to be employed as a liner, another member having an axially extending tubular cavity constituting the piece to be lined serves as encasement 21. Expansion of member 11 is carried out as described above until the member's outer wall 15 contacts inner surface 23 of the encasement (i.e. the member to be lined). Post expansion frictional forces between the member's surface 15 and the surface 23 of the encasement will hold the liner permanently in place.

The foregoing detailed description has been given for clearness of understanding only, and no unnecessary limitations should be understood therefrom, as modifications will be obvious to those skilled in the art.

I claim:

1. A method for expanding a tubular member in at least one direction transverse to the longitudinal axis of said member, said method comprising the steps of:

applying a compressive load to said member with said load being parallel to the longitudinal axis of said member;

and allowing said member to deform in said transverse direction substantially without the application of hydraulic pressure to the interior of said member and without buckling.

2. A method as recited in claim 1 and including the step of:

confining said member so as to limit said deformation in said transverse direction.

3. A method as recited in claim 2 wherein said confining step comprises:

enclosing said member in an encasement such that said encasement limits outward deformation of said member in said transverse direction.

4. A method as recited in claim 3 wherein:

said enclosing step allows localized outward deformation of said member in said transverse direction.

5. A method as recited in claim 2 wherein said confining step comprises:

providing within said member an insert which limits inward deformation or wall buckling of said member in said transverse direction.

6. A method as recited in claim 1 wherein said applying step comprises:

providing a piston;

urging said piston against one end of said member;

and restraining the other end of said member from movement parallel to said longitudinal axis of said member.

7. A method as recited in claim 1 wherein said applying step comprises:

providing a pair of opposing pistons;

and urging each of said pair of opposing pistons against a respective opposite end of said member.

8. A method as recited in claim 1 wherein said applying step comprises:

providing a piston having a beveled face;

urging said piston having said beveled face against one end of said member;

said urging step causing transversely outwardly directed friction-opposing forces to be applied to said one end of said member;

and restraining the other end of said member from movement parallel to said longitudinal axis of said member.

9. A method as recited in claim 8 wherein:

said restraining step causes transversely outwardly directed friction-opposing forces to be applied to said other end of said member.

10. A method as recited in claim 1 wherein said applying step comprises:

providing a pair of opposing pistons each located at a respective opposite end of said member;

and urging each piston against said respective opposite end of said member in a direction parallel to the longitudinal axis of said member;

said urging step causing transversely outwardly directed friction-opposing forces to be applied to at least one of said ends of said member.

11. A method as recited in claim 1 wherein said applying step comprises:

compressing said member with a load of a magnitude less than approximately one-hundred ten percent of the true ultimate strength of said member so as to maintain the original wall thickness of said member.

12. A method as recited in claim 1 wherein said applying step comprises:

compressing said member with a load of a magnitude greater than approximately one-hundred ten percent of the true ultimate strength of said member so as to increase the wall thickness of said member.

13. A method as recited in claim 1 wherein said applying step comprises:

compressing said member with a load of a magnitude greater than the elastic limit of said member so as to increase the elastic limit of said member.

14. A method as recited in claim 1 wherein said applying step comprises:

compressing said member with a load of a magnitude greater than the yield strength of said member so as to increase the yield strength and elastic limit of said member.

15. A method as recited in claim 1 wherein said applying step comprises:

compressing said member with a load of a magnitude greater than the true ultimate strength of said member so as to increase the true ultimate strength, yield strength and elastic limit of said member.

16. A method for lining a first member having an axially extending tubular cavity with a second tubular member, said method comprising the steps of:

inserting said second member inside of said first member;

and expanding said second member in directions transverse to the longitudinal axis of said second member substantially without the application of hydraulic pressure to the interior of said second member until the outer surface of said second member contacts the inner surface of said first member;

said expanding step comprising the steps of applying a compressive load to said second member with said load being parallel to said longitudinal axis and allowing said second member to deform in said transverse directions without buckling.

17. A method as recited in claim 16 wherein said applying step comprises:

providing a piston;

urging said piston against one end of said second member;

and restraining the other end of said second member from movement parallel to said longitudinal axis of said member.

18. A method as recited in claim 16 wherein said applying step comprises:

providing a pair of opposing pistons;

and urging each of said pair of opposing pistons against a respective opposite end of said second member.

19. A method as recited in claim 16 wherein said applying step comprises:

providing a piston having a beveled face;

urging said piston having said beveled face against one end of said second member;

said urging step causing transversely outwardly directed friction-opposing forces to be applied to said one end of said second member;

and restraining the other end of said second member from movement parallel to said longitudinal axis of said second member.

20. A method as recited in claim 17 wherein:

said restraining step causes transversely outwardly directed friction-opposing forces to be applied to said other end of said second member.

21. A method as recited in claim 16 wherein said applying step comprises:

providing a pair of opposing pistons each located at a respective opposite end of said second member;

and urging each piston against said respective opposite end of said second member in a direction parallel to the longitudinal axis of said second member;

said urging step causing transversely outwardly directed friction-opposing forces to be applied to at least one of said ends of said second member.

22. An apparatus for expanding a tubular member in at least one direction transverse to the longitudinal axis of said member, said apparatus comprising:

means for applying to said member a compressive load parallel to the longitudinal axis of said member; and means for allowing said member to deform in said transverse direction without buckling;

said apparatus being devoid of means for applying substantial hydraulic pressure to the interior of said member.

23. The apparatus of claim 22 and including:

means for confining said member so as to limit said deformation in said transverse direction.

24. The apparatus of claim 23, wherein said confining means comprises:

an encasement surrounding said member;

said encasement having an inner surface that is transversely outwardly spaced from said member to allow outward deformation of said member in said transverse direction.

25. The apparatus of claim 24 wherein:

said encasement includes a localized recess in said inner surface to allow localized deformation of said member in said transverse direction.

26. The apparatus of claim 23, wherein said confining means comprises:

an encasement surrounding said member;

said encasement having an inner surface that substantially conforms to and is very closely spaced relative to said member; and said encasement having a localized recess to allow only localized deformation of said member in said transverse direction.

27. The apparatus of claim 23, wherein said confining means comprises:

an insert located inside of said member to limit inward deformation or wall buckling of said member in said transverse direction.

28. The apparatus of claim 22, wherein said applying means comprises:

a piston means axially adjacent one end of said member;

means for urging said piston means against said one end of said member; and means axially adjacent the end of said member opposite said one end for restraining said opposite end from movement parallel to the longitudinal axis of said member.

29. The apparatus of claim 28, wherein:

at least one of said piston means and said restraining means includes a beveled face comprising means for causing transversely outwardly directed friction-opposing forces to be applied to a respective end of said member when said member is under said compressive load.

30. The apparatus of claim 22, wherein said applying means comprises:

a piston means axially adjacent each end of said member; and means for urging each of said piston means against a respective opposite end of said member.

31. The apparatus of claim 30, wherein:

at least one of said piston means includes a beveled face comprising means causing transversely outwardly directed friction-opposing forces to be applied to said respective end of said member when said member is under said compressive load.

* * * * *